US006561442B2

(12) United States Patent
Boecking

(10) Patent No.: US 6,561,442 B2
(45) Date of Patent: May 13, 2003

(54) INJECTOR/NOZZLE NEEDLE COMBINATION WITH COUPLING ON THE END ORIENTED TOWARD THE CONTROL CHAMBER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/900,964

(22) Filed: Jul. 10, 2001

(65) Prior Publication Data

US 2002/0056766 A1 May 16, 2002

(30) Foreign Application Priority Data

Jul. 10, 2000 (DE) ..... 100 33 426

(51) Int. Cl.[7] ..... F02M 61/08

(52) U.S. Cl. ..... 239/533.8; 239/533.3; 239/533.9; 239/124

(58) Field of Search ..... 239/88, 96, 533.2, 239/533.3, 533.4, 533.5, 533.7, 533.8, 533.9, 124

(56) References Cited

U.S. PATENT DOCUMENTS 5,979,790 A * 11/1999 Gurich et al. ..... 239/88
5,984,200 A * 11/1999 Augustin ..... 239/88
6,367,709 B2 * 4/2002 Heinz et al. ..... 239/96

* cited by examiner

*Primary Examiner*—Christopher Kim
(74) *Attorney, Agent, or Firm*—Ronald E. Greigg

(57) ABSTRACT

An injector for injecting fuel into the combustion chambers of a direct-injection internal combustion engine includes a control part which is received movably in the housing of the engine. The control part opens and closes the inlet to an injection nozzle at a seat face. In the control part, there is an inlet throttle, which acts upon the control chamber and is in communication with the inlet from the high-pressure collection chamber. In the housing of the injector, one region of the control part is coupled with a nozzle needle, via a further control chamber.

11 Claims, 1 Drawing Sheet

INJECTOR/NOZZLE NEEDLE COMBINATION WITH COUPLING ON THE END ORIENTED TOWARD THE CONTROL CHAMBER

BACKGROUND OF THE INVENTION

1. Field of the Invention

The invention relates to an injector/nozzle needle combination, with a control chamber coupling, for injecting fuel which is at high pressure into the combustion chambers of a direct-injection internal combustion engine. In injectors that are used to inject fuel, which is at high pressure, into the combustion chambers of an internal combustion engine, fast closure of the nozzle needle is a goal, once the injection phase, either a preinjection phase or a main injection phase, has been concluded.

2. Prior Art

German Patent DE 37 28 817 C2 relates to a fuel injection pump for internal combustion engines. In the device of this German patent, a control valve member comprises a valve shaft, which forms a guide sleeve and slides in a conduit, and a valve head connected to it and oriented toward the actuating device.

Also in this device, the sealing face of the valve head is embodied to cooperate with the face, forming the valve seat, of the control bore. The valve shaft, on its circumference, has a recess whose axial length extends from the discharge opening of the fuel supply line to the beginning of the sealing face, cooperating with the valve seat, on the valve head. A face exposed to the pressure of the fuel supply line is embodied in the recess, and the surface area of this face is equal to a surface area of the valve head that in the closed state of the control valve is exposed to the pressure of the fuel supply line. As a result, it can be attained that the valve in the closed state is pressure-equalized, and hence the mechanical stresses on the control valve member known from DE 37 28 817 C2 are drastically reduced. Furthermore, a spring urging the control valve toward its open position is disposed in the guide sleeve already mentioned.

In this arrangement from the prior art, no provision for positive control of a nozzle needle whose inflow is effected via a control valve unit supported displaceably laterally in the injector housing is provided.

SUMMARY OF THE INVENTION

With the embodiment proposed according to this invention, a pressure-controlled injector assembly can be achieved whose nozzle needle can be positively controlled for closing and opening. By the opening or closing of the control chamber, provided in the upper region of the housing of the injector, a negative pressure, or an overpressure can be generated in a further control chamber inside the housing of the injector, which assists movement of the nozzle needle of the injector vertically up and down in its guide. The further control chamber is alternatively, by means of movement of a control part, in communication with either the leaking oil side or the high-pressure side. The pressure in the further control chamber is affected solely by the motion of the control part.

In an upward motion of the control part into its housing bore, outward motion of a face end of the control part, which represents a boundary of the further control chamber, causes a negative pressure in the further control chamber, and the opening of the nozzle needle out of its seat is reinforced.

Along with the pressure shoulder embodied on the nozzle needle, on which pressure shoulder a pressure prevailing in the high-pressure collection chamber acts via the nozzle inlet, the nozzle needle opening is reinforced by the negative pressure generated in the further control chamber.

Conversely, in the case of closure of the nozzle needle by insertion of the face end of the control part into the further control chamber, the insertion motion of the nozzle needle into its seat is reinforced. This takes away the possibility of postinjections into the combustion chamber of a direct-injection internal combustion engine. With the possibility of positive control of the nozzle as proposed by the invention, via its pressure control, a precise conversion of a triangularly configured injection nozzle pressure can be established. Besides the action on the nozzle chamber and its relief via the leaking oil outlets, the injection nozzle can be urged, by the changes in pressure in the further control chamber in directions that reinforces the opening and closing events of the injection bore, so that an optimal triangular course of injection can ensue. To achieve an optimal, triangularly configured pressure course at the tip of the injection nozzle, it is extremely important for postinjections into the combustion chambers of a direct-injection internal combustion engine to be prevented by fast needle closure. The embodiment according to the invention, where the nozzle needle is acted upon via a further control chamber, is especially simple to accomplish from a production standpoint and makes a major contribution to this prevention of postinjections.

BRIEF DESCRIPTION OF THE DRAWING

The invention is described in further detail below in conjunction with the sole FIGURE of the drawing which is a longitudinal section through the injector, configured according to the invention, whose control part is defined by two control chambers, and one of these control chambers is simultaneously used for triggering the nozzle needle.

BRIEF DESCRIPTION OF THE PREFERRED EMBODIMENTS

Figure 1:
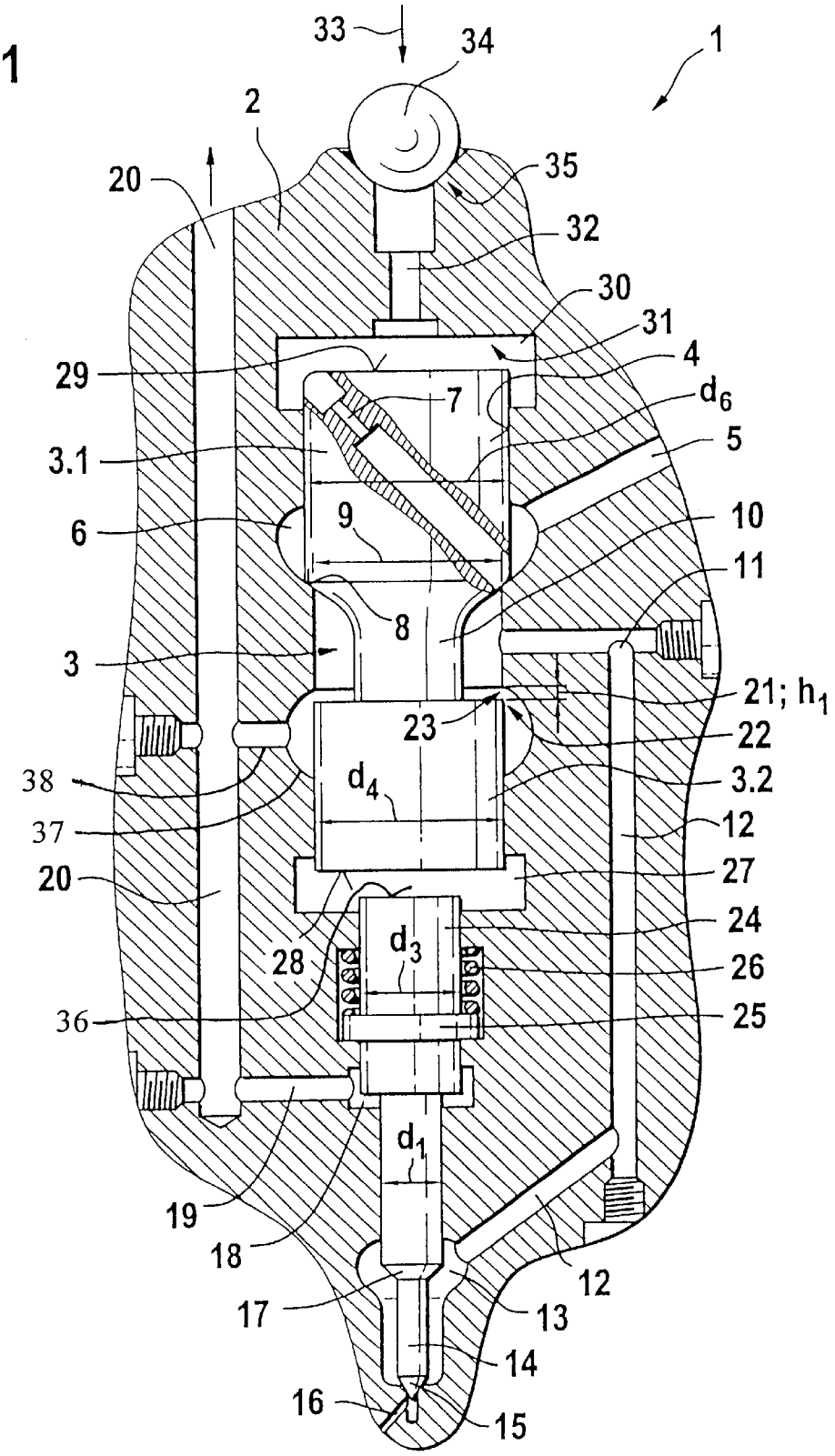

In the drawing, a longitudinal section through the injector configured according to the invention is shown, which has two control chambers, of which the upper one can be pressure-relieved, or can be acted upon by pressure, via a separately actuatable actuator element.

The injector 1 according to the invention, shown in its essential elements in FIG. 1, includes an injector housing 2, with a control part 3 let into its bore 4. The control part 3, which contains an upper part 3.1 and a lower part 3.2, is disposed so as to be movable vertically up and down in the bore 4. The control part 3 is embodied essentially rotationally symmetrically about its axis. A valve chamber 6 is provided, surrounding a portion of the upper part 3.1 of the control part 3, in the housing 2 of the injector 1. An inlet 5 from a high-pressure collection chamber (common rail) discharges into the valve chamber 6, which has a crescent-shaped configuration.

The upper part 3.1 of the control part 3 is adjoined by a region of the control part 3, which is embodied as a constriction 10. Below the constriction 10 in the control part 3 is the lower part 3.2, which serves as a leaking oil slide. The end face 28 of the leaking oil slide 3.2 on the lower part of the control part 3 represents a boundary of the further control chamber 27, which is embodied in the housing 2 of the injector.

The valve chamber 6, which is embodied in the housing 2 of the injector, is closed on the underside of the upper part 3.1 of the control part 3 by the seat diameter 9. To that end, the control part 3, or in other words its upper part 3.1, is positioned with the seat diameter 9 against the seat face 8, by means of a pressure generated in the upper control chamber 30. In this state, the inlet 12 to the nozzle chamber 13 of the nozzle needle 14 of the injection nozzle system is closed and does not communicate with the pressure of the high-pressure collection chamber that prevails in the valve chamber 6. The discharge opening 11 of the nozzle inlet 12 extends into the region of the constriction 10 that is embodied between the upper part 3.1 and the lower part 3.2, acting as a leaking oil slide, of the control part 3. From the discharge opening 11, the nozzle inlet 12 extends into a nozzle chamber 13, which is penetrated by a nozzle needle 14 that in turn is received with a nozzle tip 15 in the nozzle seat. A bore 16 is embodied on the nozzle seat, through which bore the fuel present at extremely high pressure in the nozzle chamber 13 can be injected into the combustion chambers of an internal combustion engine. The nozzle needle 14, in its region that penetrates the nozzle chamber 13, is embodied with a pressure shoulder 17, by which the nozzle needle and a pressure piece 24, connected to it, are thrust into an opening position, that is, upward, upon imposition of fuel at high pressure on the nozzle chamber 13. Above the region of the nozzle needle 14, which is embodied with the diameter $d_1$, there is a leaking oil chamber 18 in the transitional region to the pressure piece 24; this chamber communicates via an outlet 19 with a leaking oil line 20, by way of which the leaking oil can be pumped back into the tank of a motor vehicle. The transition between the region of the nozzle needle 14 embodied with the diameter $d_1$ and an adjoining pressure piece 24, embodied with a diameter $d_3$, is embodied in the leaking oil chamber 18. The pressure piece 24 is surrounded on its outside by a stop 25 extending annularly around the circumference, and a spring element 26 is braced on this stop. The spring element 26 is braced on the opposed annular end face of the hollow chamber in which it is received. The end face 36 of the pressure piece 24 forms a second boundary face of the further control chamber 27, embodied in the housing 2 of the injector 1.

For relief of the nozzle chamber 13 via the nozzle inlet 12, the lower part 3.2 of the control part 3, acting as a leaking oil slide, is surrounded by an annular recess 37, which communicates via a transverse bore 38 with the leaking oil line 20. On the upper end of the lower part 3.2 is a slide edge 22 of the control part that cooperates with a control edge 21 provided in the housing 2. The stroke required to cause the two control edges to overlap is marked $h_1$. In the position shown in FIG. 1, the high pressure prevailing in the nozzle chamber 13 and thus in the nozzle inlet 12 can be dissipated into the leaking oil line 20 via the annular control recess 37 surrounding the leaking oil slide 3.2 being in communication with the opening around constriction 10, and also in communication with the transverse bore 38. To that end, the two control edges 21, 22 are moved apart by the stroke length $h_1$ and make the pressure relief to the leaking oil line possible.

In the upper region of the control part 3.1, the control part protrudes with its upper end face 29 into an upper control chamber 30 of the housing 2. The upper control chamber 30 is acted upon continuously by a control volume via an inlet throttle 7 that is included in the upper part 3.1 of the control part 3. Via the inlet throttle 7 extending obliquely through the upper part 3.1 of the control part 3, the fuel entering the valve chamber 6 from the high-pressure collection chamber via the inlet 5 also enters the upper control chamber 30, so that this chamber is constantly filled with a control volume. Above the upper control chamber 30, this chamber is defined by a wall 31, in which an outlet throttle 32 is provided approximately coaxially to the line of symmetry of the control part 3. This throttle discharges into a hollow chamber, which is closed by a spherical, or otherwise shaped, closing element 34.

The closing element can be urged in the operative direction by a final control element or actuator, such as a piezoelectric actuator, an electromagnet, or a hydraulic/mechanical booster, so that the spherically embodied closing element upon contact with its seat 35 closes the outlet throttle 32, so that the control volume held in reserve in the upper control chamber 30 remains constant and is not pressure-relieved. Accordingly, the control volume cannot escape from the upper control chamber 30 of the housing 2 of the injector 1. As a consequence, the control part 3 is kept in its position shown in FIG. 1, in which it closes the seat face 8.

The mode of operation of the injector shown in FIG. 1, with a positively controlled nozzle needle 14 or pressure piece 24, is as follows:

Through the inlet 5 from the high-pressure collection chamber, the high pressure prevailing in the high-pressure collection chamber always prevails in the control chamber 30 of the housing 2, via the inlet throttle 7. As a result, the control chamber 30 in the housing 2 of the injector 1 is always filled with a fuel volume. If the control chamber 30 is actuated by lifting the closing element 34 off of its seat 35, control volume flows out of the upper control chamber 30 via the outlet throttle 32. As a result, the upper end face 29 on the upper part 3.1 of the control part 3 moves into the upper control chamber 30. In this movement, the seat diameter 9 moves out of the seat face 8, and the fuel at high pressure present in the valve chamber 6 shoots into the hollow chamber, formed between the bore 4 of the housing 2 surrounding constriction 10, above the lower part, acting as a leaking oil slide, of the control part 3 and flows via the discharge opening 11 into the nozzle inlet 12 and from there into the nozzle chamber 13. In this case, the lower part 3.2 of the control part 3, which acts as a leaking oil slide, has moved upward, so that the control edges 22 and 21 overlap one another, and the recess annularly surrounding the lower part 3.2 of the control part 3 is sealed off from the leaking oil line 20. This prevents a short circuit from inlet 5 from the high-pressure collection chamber to the leaking oil line 20. This makes a major contribution to enhancing the efficiency of the injector.

Because of the imposition on the nozzle inlet 12 and the nozzle chamber 13, fuel at high pressure is present in the nozzle chamber. The fuel pressure prevailing in the nozzle chamber 13 causes the nozzle needle 14 to move upward by a vertical motion as a result of the presence of the high pressure at the pressure shoulder 17 between the nozzle needle 14 and the region embodied above it in the nozzle needle at the diameter $d_1$. As a result, the nozzle needle 14 and the pressure piece 24 connected to it moves into the further pressure or control chamber 27. As a result of the previously described upward motion of the control part 3 upon pressure relief of the upper control chamber 30, a negative pressure is generated in the further control chamber 27. The generation of the negative pressure in the further control chamber 27 has the effect that the upward motion of the pressure piece 24 and thus of the nozzle needle 14, generated by the fuel pressure present in the nozzle chamber 13 and acting on the pressure shoulder 17, is reinforced, and faster opening of the nozzle needle at its tip 15 can take place. As a result, the bore 16 is subjected at a precisely defined instant to a fuel volume which is at high pressure, for injection into the combustion chambers of a direct-injection internal combustion engine. The leakage that occurs in the vertical motion of the nozzle needle 14 or pressure piece 24 is diverted on the leaking oil side into the leaking oil line 20, via the leaking oil chamber 18, which is disposed in the transition region between the pressure piece 24 and the portion of the nozzle needle having the diameter $d_1$.

Upon movement of the actuator 33 in the operative direction indicated by the arrow, the spherical closing element 34 is pressed into its seat face 35. As a result, the outlet throttle 32 is closed, so that by continuous replenishing flow of fuel via the inlet 5 through the inlet throttle 7, a pressure buildup takes place in the upper control chamber 30. Because of the pressure buildup in the upper control chamber 30, the control part 3, by the presence of the pressure at the end face 29 of the upper part 3.1 of the control part 3, moves into its seat 8 and with the seat diameter 9 closes the valve chamber 6, so that the discharge opening 11 of the inlet 12 in the nozzle chamber 13 is cut off from the high pressure.

Simultaneously, a relief of the nozzle system 13, 12, 11 has taken place, because the control edges 21 and 22 of housing and the lower part 3.2, functioning as a leaking oil slide, of the control part 3 have opened, so that between the control edges, the stroke $h_1$ shown in FIG. 1 is established, and a relief on the leaking oil side of the high pressure in the injection nozzle system can take place. This happens through the annular chamber 37 surrounding the lower part 3.2 of the control part 3, the fuel flows through transverse bore 38 into the leaking oil line 20, so that both the nozzle chamber 13 and the nozzle inlet 12 are pressure-relieved. The ensuing closing motion of the nozzle needle 14 or pressure piece 24 is reinforced by the fact that in the downward motion of the control part 3 forces its control face 28 on the lower part 3.2 into the further control chamber 27. As a result, the pressure in the further control chamber 27 in the housing 2 of the injector 1 is increased significantly, so that the pressure piece 24, reinforced by the spring 26 acting on the stop 25, is moved vertically downward, and the nozzle needle 14 with its nozzle tip 15 moves rapidly into its seat. This causes a fast closure of the nozzle needle after pressure relief of the injection nozzle system 13, 12, 11. Any leakage that ensues flows away into the leaking oil line 20, via the leaking oil chamber 18 that is embodied in the transition region between the pressure piece 24 and the nozzle needle 14.

Thus the injector proposed according to the invention for injecting fuel into the combustion chambers of a direct-injection internal combustion engine can be designed as a pressure-controlled high-pressure injector with positive control of the nozzle needle, which enables fast closure of the nozzle needle tip at its seat 15. This is attained by means of vertical motion of only a single final control element, namely the control part 3, in the bore 4 of the housing 2. By means of the fast needle closure, reinforced by the variation of pressure in the further control chamber 27 inside the housing 2, an optimal triangularly configured pressure course can be attained with the injector configuration.

The foregoing relates to preferred exemplary embodiments of the invention, it being understood that other variants and embodiments thereof are possible within the spirit and scope of the invention, the latter being defined by the appended claims.

I claim:

1. An injector for injecting fuel into the combustion chambers of a direct-injection internal combustion engine, comprising, a control part (3) which is movable in a housing (2) to open or close an inlet (11) to an injection nozzle by means of a seat diameter (9) of the control part engaging a seat face (8) of the housing, and in which control part has an inlet throttle (7) in said control part, acting upon an upper control chamber (30), which inlet throttle (7) communicates with an inlet (5) from a high-pressure collection chamber, one region (3.2) of the control part (3) being coupled to a nozzle needle (14), (24) via a further control chamber (27).

2. The injector of claim 1, wherein the further control chamber (27) is defined by the housing (2) of the injector (1) and by a face (28) of the control part (3) and a face (36) of the nozzle needle (14), (24).

3. The injector of claim 2, wherein the face (28) of the control part (3) is the end face (28) of said one region (3.2) of the control part (3).

4. The injector of claim 1, wherein said one region (3.2) of the control part (3) is a leaking oil slide.

5. The injector of claim 4, wherein the control part (3) is provided with a constriction (10) above said one region (3.2).

6. The injector of claim 1, wherein upon pressure relief of the upper control chamber (30), a vertically upward-oriented motion of the control part (3) ensues, which generates a negative pressure in the further control chamber (27).

7. The injector of claim 1, wherein, upon a pressure increase in the upper control chamber (30), a vertically downward-oriented motion of the control part (3) ensues, which generates a pressure increase in the further control chamber (27).

8. The injector of claim 6, wherein the creation of negative pressure in the further control chamber (27) serves to control a nozzle needle (24), (14) in the housing (2).

9. The injector of claim 7, wherein the creation of a pressure increase in the control chamber (27) serves to control a nozzle needle (24), (14) in the housing (2).

10. The injector of claim 1, wherein a pressure piece (24) which is surrounded by an annular element (25) on which a spring element (26) is braced is embodied on the nozzle needle (14).

11. The injector of claim 1, wherein a pressure piece (24) which is surrounded by an annular element (25) on which a spring element (26) is braced is embodied on the nozzle needle (14), and wherein, in a transitional region from the pressure piece (24) to the nozzle needle (14), a leaking oil chamber (18) is provided, by way of which leaking oil flows out from a nozzle chamber (13), and a pressure shoulder (17) is embodied on the nozzle needle (14).

* * * * *